US008528527B2

(12) United States Patent
Rauner et al.

(10) Patent No.: US 8,528,527 B2
(45) Date of Patent: Sep. 10, 2013

(54) MOTOR VEHICLE

(75) Inventors: Thomas Rauner, Blaubeuren (DE); Stefan Fischer, Stuttgart (DE)

(73) Assignee: Dr. Ing. h.c.f. Porsche Aktiengesellschaft (DE)

( * ) Notice: Subject to any disclaimer, the term of this patent is extended or adjusted under 35 U.S.C. 154(b) by 426 days.

(21) Appl. No.: 13/006,715

(22) Filed: Jan. 14, 2011

(65) Prior Publication Data

US 2011/0186019 A1 Aug. 4, 2011

(30) Foreign Application Priority Data

Jan. 29, 2010 (DE) ..... 10 2010 006 123

(51) Int. Cl.
*F02M 33/02* (2006.01)

(52) U.S. Cl.
USPC ..... 123/518

(58) Field of Classification Search
USPC ... 123/516–520; 220/366.1, 303; 180/65.21; 137/571
See application file for complete search history.

(56) References Cited

U.S. PATENT DOCUMENTS

| | | | | |
|---|---|---|---|---|
| 4,086,897 | A * | 5/1978 | Tamura et al. | 123/520 |
| 5,056,494 | A * | 10/1991 | Kayanuma | 123/519 |
| 5,220,898 | A | 6/1993 | Kidokoro et al. | |
| 5,269,278 | A * | 12/1993 | Heinemann et al. | 123/520 |
| 5,553,577 | A * | 9/1996 | Denz et al. | 123/198 D |
| 6,067,967 | A | 5/2000 | Kidokoro et al. | |
| 6,279,547 | B1 | 8/2001 | Mancini et al. | |
| 7,107,971 | B2 | 9/2006 | Spink et al. | |
| 2009/0007890 | A1 | 1/2009 | Devries et al. | |

FOREIGN PATENT DOCUMENTS

DE 10 2007 040 913 3/2009

* cited by examiner

*Primary Examiner* — Stephen K Cronin
*Assistant Examiner* — Elizabeth Hadley
(74) *Attorney, Agent, or Firm* — Gerald E. Hespos; Michael J. Porco; Matthew T. Hespos

(57) ABSTRACT

A motor vehicle has an internal combustion engine, a fuel tank and a tank ventilation device. The fuel tank is connected via a first and second tank ventilation lines to an intake tract of the internal combustion engine. A hydrocarbon store has first and second chambers separated by a diaphragm. The first chamber is connected in communicating fashion to the first tank ventilation line and the second chamber is connected in communicating fashion to the second tank ventilation line. Valves are arranged in the first tank ventilation line upstream and downstream of the first chamber. A valve is arranged in the second tank ventilation line between the second chamber and the intake tract.

6 Claims, 1 Drawing Sheet

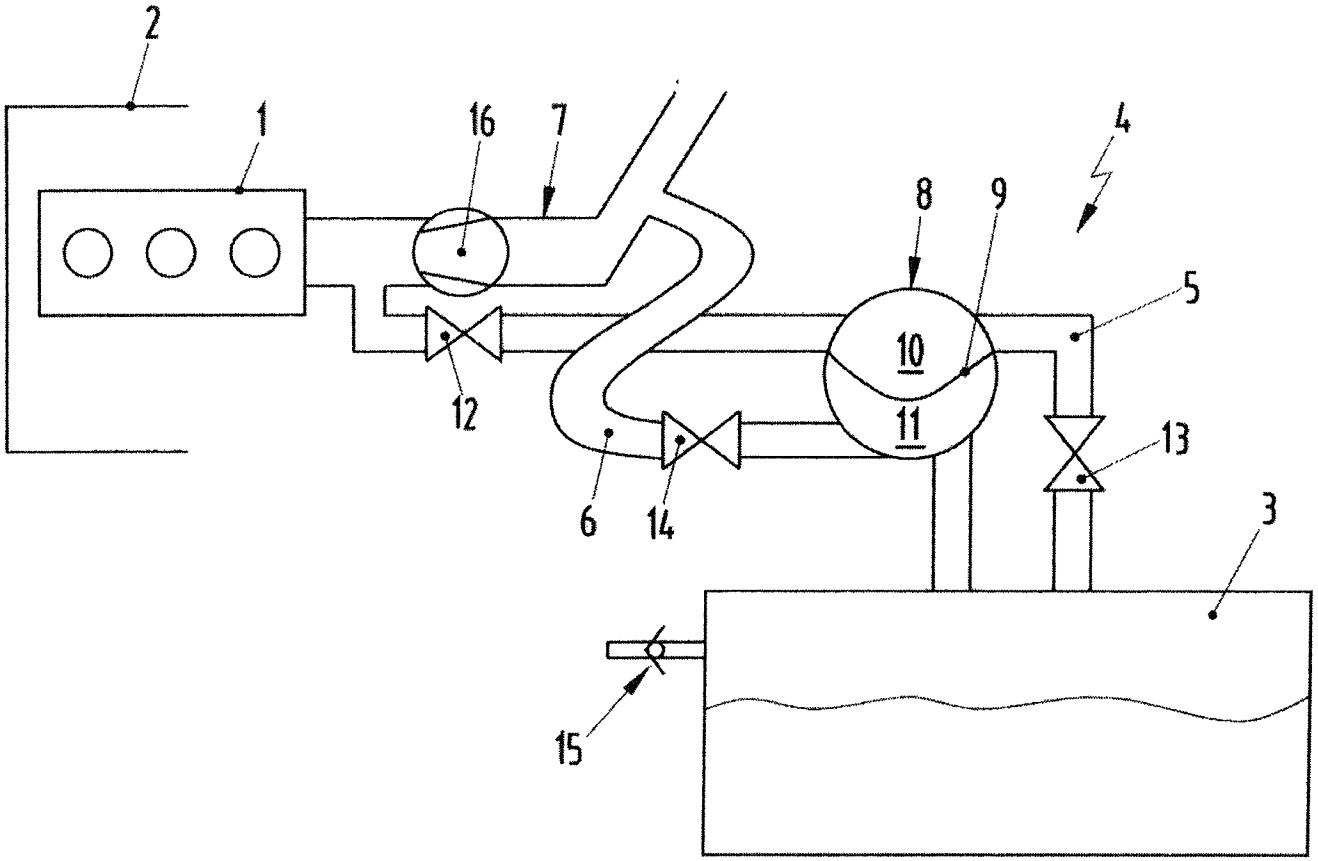
1
2
3
4
5
6
7
8
9
10
11
12
13
14
15
16

MOTOR VEHICLE

CROSS-REFERENCE TO RELATED APPLICATION

This application claims priority under 35 USC 119 to German Patent Application No. 10 2010 006 123.9, filed on Jan. 29, 2010, the entire disclosure of which is incorporated herein by reference.

BACKGROUND OF THE INVENTION

1. Field of the Invention

The invention relates to a motor vehicle having an internal combustion engine, a fuel tank and a tank ventilation device.

2. Description of the Related Art

U.S. Pat. Nos. 6,279,547 B1 and 6,067,967 disclose generic motor vehicles.

To meet ever more stringent environmental requirements, in modern motor vehicles, an activated carbon filter is installed in the region of a tank ventilation arrangement. The activated carbon filter is intended to prevent an undesired escape of hydrocarbons into the environment. Activated carbon filters conventionally serve merely as a buffer for hydrocarbons, and must be flushed while the internal combustion engine is running in view of their finite volume. Flushing is carried out, in a known way, by means of a negative pressure in an intake tract of the internal combustion engine. The greater the magnitude of the negative pressure, the more hydrocarbons can be sucked out of the activated carbon filter. In conventionally driven motor vehicles, flushing is sufficient to be able to always keep the filter action of the activated carbon filter at an adequately high absorption level. However, in hybrid vehicles, no flushing of the activated carbon filter takes place during electric driving. Thus, under some circumstances, a situation may arise in which the absorption capacity of the activated carbon filter is exceeded, and subsequently hydrocarbons could be discharged into the atmosphere. This situation must imperatively be avoided.

Therefore, the present invention is concerned with increasing storage capacity for hydrocarbons for a generic motor vehicle.

SUMMARY OF THE INVENTION

The invention relates to a motor vehicle having an internal combustion engine, a fuel tank and a tank ventilation device. The fuel tank is connected via a first and a separately formed second tank ventilation line to an intake tract of the internal combustion engine. A hydrocarbon store that can be acted on with pressure is integrated into the two tank ventilation lines. The hydrocarbon store has two chambers separated by a diaphragm. The first chamber is connected in communicating fashion to the first tank ventilation line and the second chamber is connected in communicating fashion to the second tank ventilation line. A first valve and a second valve are provided in the first tank ventilation line upstream and downstream respectively of the first chamber, while a tank ventilation valve is provided in the second tank ventilation line between the second chamber and the intake tract of the internal combustion engine. The first valve, which is arranged in the first tank ventilation line and located between the intake tract and the hydrocarbon store, is activated and opened if an excess pressure prevails in the intake tract, while the second valve, which is located between the hydrocarbon store and the tank, remains closed. In this way, an excess pressure is generated in the first chamber of the hydrocarbon store. The excess pressure pushes the diaphragm in the hydrocarbon store into the second chamber. The first valve subsequently is closed so that the excess pressure prevailing in the first chamber is stored in the hydrocarbon store and simultaneously held constant. The second valve located between the hydrocarbon store and the fuel tank subsequently is opened so that the excess pressure prevailing in the first chamber flows from the first chamber into the fuel tank. The flow exerts a pressure via the second tank ventilation line into the second chamber of the hydrocarbon store, and therefore has the effect of reducing the volume of the first chamber and therefore increasing the volume of the second chamber. At this time, the second valve, which is located between the hydrocarbon store and the fuel tank, now is closed. At the same time, the tank ventilation valve located between the internal combustion engine, or the intake tract thereof, and the second chamber of the hydrocarbon store is opened. As a result, the hydrocarbon-laden air passes into the intake tract of the internal combustion engine, and there, is supplied for combustion. The second valve, which is located between the first chamber of the hydrocarbon store and the fuel tank, closes above a predefined limit value of the pressure in the first chamber of the hydrocarbon store. If a negative pressure prevails in the intake tract of the internal combustion engine, all the valves, or at least the tank ventilation valve located in the second tank ventilation line, are opened. As a result, hydrocarbon vapors can be sucked out of the individual tank ventilation lines and out of the fuel tank. In this case, pressure compensation in the fuel tank is realized by a check valve in the fuel tank. The check valve opens above a predetermined magnitude of negative pressure. The hydrocarbon store of the invention can be acted on with pressure. Thus, the motor vehicle can be a hybrid vehicle equipped with an electric motor as a drive variant. Even in an electric motor drive mode, sufficient pressure generated in the preceding internal combustion engine drive mode can be stored in the hydrocarbon store to be able to at least temporarily buffer the relatively high quantities of hydrocarbon vapors from the fuel tank which occur even in hot weather. The activated carbon filter previously arranged at this location may be dispensed with. As a result, flushing processes for regenerating the activated carbon filter may also be dispensed with.

It is self-evident that the features mentioned above and the features yet to be explained below may be used not only in the respectively specified combination but rather also in other combinations or individually without departing from the scope of the invention.

A preferred exemplary embodiment of the invention is illustrated in the drawing and will be explained in more detail in the following description.

BRIEF DESCRIPTION OF THE DRAWINGS

FIG. 1 shows a generic motor vehicle having a tank ventilation arrangement according to the invention.

DETAILED DESCRIPTION OF THE PREFERRED EMBODIMENT

An internal combustion engine is identified by the numeral 1 in FIG. 1 and is part of a motor vehicle 2 that also has a fuel tank 3 and a tank ventilation device 4. According to the invention, the fuel tank 3 is connected in communicating fashion via first and second tank ventilation lines 5 and 6 to an intake tract 7 of the internal combustion engine 1. A hydrocarbon store 8 is integrated into the two tank ventilation lines 5 and 6. The hydrocarbon store 8 has first and second chambers 10 and 11 that are separated from one another by a diaphragm 9. The first chamber 10 is connected in communicating fashion to the first tank ventilation line 5, whereas the second chamber 11 is connected in communicating fashion to the second tank ventilation line 6. First and second valves 12 and 13 are provided in the first tank ventilation line 5 at respective positions upstream and downstream of the first chamber 10. A tank ventilation valve 14 is arranged in the second tank ventilation line 6 between the second chamber 11 and the intake tract 7 of the internal combustion engine 1. Furthermore, a check valve 15 may be provided on the fuel tank 3. The tank ventilation device 4 of the invention is of interest in particular for motor vehicles 2 that are designed as hybrid vehicles and which therefore have, an electric motor (not shown) for providing electromotive drive in addition to the internal combustion engine 1.

The hydrocarbon store 8 is formed according to the size of the fuel tank 3. For example, in the case of a fuel tank 3 with a volume of approximately 80 liters, a pressure store is provided with a diameter of approximately 35 cm at an internal pressure of at least 10 bar.

In general, the tank ventilation device 4 according to the invention functions as follows:

The second valve 13 and the tank ventilation valve 14 are closed and only the first valve 12 in the first tank ventilation line 5 is opened if an excess pressure prevails in the intake tract 7 of the internal combustion engine 1. This naturally leads to an increase in the pressure in the first chamber 10 of the hydrocarbon store 8. The pressure increase in the first chamber 10 moves the elastic diaphragm 9 in the direction of the second chamber 11, and hence reduces the volume of the second chamber 11. Subsequently, the first valve 12 is closed and the second valve 13 and the tank ventilation valve 14 are opened. Thus, the excess pressure prevailing in the first chamber 10 generates a flow through the first tank ventilation line 5 via the fuel tank 3 into the second chamber 11. The tank ventilation valve 14 still is open at this time. As a result, the hydrocarbon-laden air from the fuel tank 3 is forced into the intake tract 7 of the internal combustion engine 1 and is supplied for combustion. The second tank ventilation line 6 opens into the intake tract 7 upstream of a supercharger 16 and can be compressed once again before being supplied to the internal combustion engine 1. The second valve 13 is closed if the excess pressure prevailing in the first chamber 10 falls below a predefined value. An excess pressure then is built up once again in the first chamber 10 of the hydrocarbon store 8 by virtue of the first valve 12 being opened. The supercharger 16, for example, may be utilized for this purpose.

In contrast, if a negative pressure prevails in the intake tract 7, then depending on the loading of the hydrocarbon store 8, all of the valves 12, 13 and 14 can be opened. Thus, the hydrocarbon vapors contained in the fuel tank 3 are sucked out. The check valve 15 opens in this situation and fresh air from the outside is sucked into the fuel tank 3 to prevent a negative pressure of too great a magnitude from prevailing in the fuel tank 3.

The first tank ventilation line 5 opens into the intake tract 7 of the internal combustion engine downstream of the supercharger 16, as shown FIG. 1. As a result, the excess pressure, required for the flushing of the fuel tank 3, in the first chamber 10 of the hydrocarbon store 8 can be generated by the supercharger 16. An activated carbon filter that previously was required can be dispensed with in the tank ventilation device 4 of the invention. Furthermore, the hydrocarbon store 8 may be designed to be of such a size to have a considerably higher capacity for storing hydrocarbons than a conventional activated carbon filter. A particular advantage of the tank ventilation device 4 of the invention however is that it also can be used in hybrid vehicles, as a result of which storage of the hydrocarbon vapors in the hydrocarbon store 8 can take place.

The motor vehicle 2 of the invention, or the hydrocarbon store 8 of the invention enable a considerable contribution to an improved level of environmental compatibility of motor vehicles.

What is claimed is:

1. A motor vehicle comprising:

an internal combustion engine;

a fuel tank;

first and second tank ventilation lines connecting the fuel tank to an intake tract of the internal combustion engine;

a hydrocarbon store having first and second chambers separated by a diaphragm, the first chamber being connected in communicating fashion to the first tank ventilation line and the second chamber being connected in communicating fashion to the second tank ventilation line;

valves arranged in the first tank ventilation line upstream and downstream of the first chamber; and a tank ventilation valve arranged in the second tank ventilation line between the second chamber and the intake tract.

2. The motor vehicle of claim 1, wherein the hydrocarbon store is a pressure store.

3. The motor vehicle of claim 1, wherein the motor vehicle is a hybrid vehicle and has at least one electric motor as an alternative drive.

4. The motor vehicle of claim 1, further comprising a supercharger in the intake tract.

5. The motor vehicle of claim 4, wherein the first tank ventilation line opens into the intake tract upstream of the supercharger and the second tank ventilation line opens into the intake tract downstream of said supercharger.

6. The motor vehicle of claim 4, further comprising a check valve in the fuel tank and communicating with ambient surroundings for prevent pressure in the fuel tank from being below a predetermined minimum.

* * * * *